United States Patent [19]

Peterson et al.

[11] 4,357,208

[45] * Nov. 2, 1982

[54] METHOD OF MAKING PULP

[75] Inventors: Per V. Peterson, Sundsvall; Hans E. Höglund, Matfors, both of Sweden

[73] Assignee: SCA Development Aktiebolag, Sweden

[ * ] Notice: The portion of the term of this patent subsequent to Jul. 28, 1998, has been disclaimed.

[21] Appl. No.: 196,701

[22] PCT Filed: Jan. 18, 1979

[86] PCT No.: PCT/SE79/00013

§ 371 Date: Oct. 17, 1979

§ 102(e) Date: Sep. 27, 1979

[87] PCT Pub. No.: WO79/00634

PCT Pub. Date: Sep. 6, 1979

[30] Foreign Application Priority Data

Feb. 17, 1978 [SE] Sweden ..... 7801877

[51] Int. Cl.[3] ..... D21B 1/12

[52] U.S. Cl. ..... 162/23; 162/25; 162/28

[58] Field of Search ..... 241/28; 162/26, 24, 162/25, 28, 17, 19, 23

[56] References Cited

U.S. PATENT DOCUMENTS

| | | | |
|---|---|---|---|
| 1,795,603 | 3/1931 | Hussey | 241/28 |
| 2,734,685 | 2/1956 | Saito | 241/46 |
| 3,446,699 | 5/1969 | Asplund et al. | 162/19 |
| 3,467,574 | 9/1969 | West | 162/26 |
| 3,617,006 | 11/1971 | Jones | 241/28 |
| 3,627,629 | 12/1971 | Miller | 162/17 |
| 3,790,092 | 2/1974 | Reinhall | 241/38 |
| 4,166,584 | 9/1979 | Asplund | 241/261.3 |

FOREIGN PATENT DOCUMENTS

| | | |
|---|---|---|
| 279787 | 4/1965 | Australia . |
| 657665 | 9/1951 | United Kingdom . |

*Primary Examiner*—Peter Chin

*Attorney, Agent, or Firm*—Lerner, David, Littenberg & Samuel

[57] ABSTRACT

Lignocellulose material is pretreated with steam, heat, lignin softening chemicals or combinations thereof. The pretreated material is then refined in a disc refiner. Water is added to the material in the refining zone of the disc refiner to form a suspension at concentration of 8–15% at the point of discharge from the gap between the discs of the refiner. Steam development and steam backflow from the gap is reduced.

6 Claims, 1 Drawing Figure

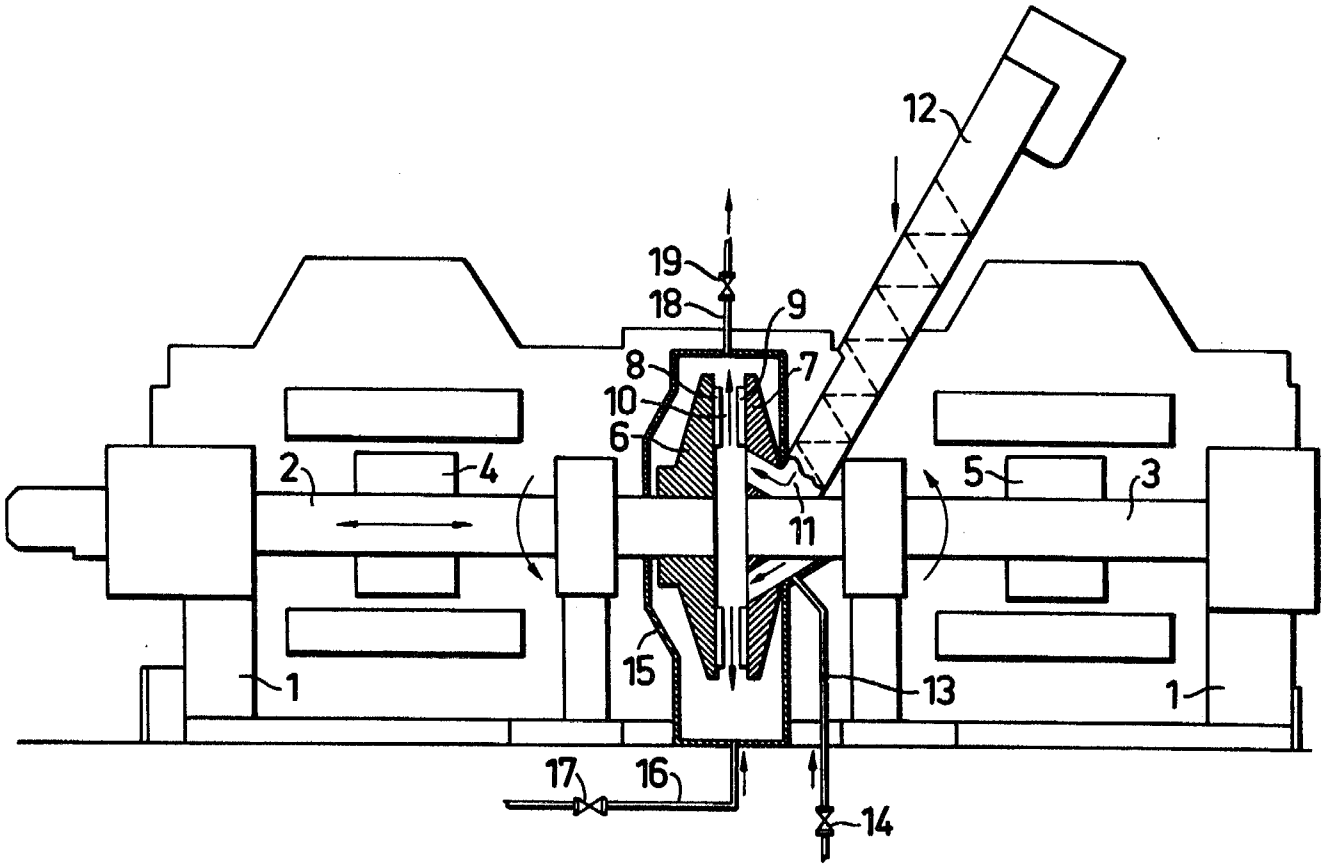
1
2
3
4
5
6
7
8
9
10
11
12
13
14
15
16
17
18
19

METHOD OF MAKING PULP

This invention relates to a method of making refiner pulp of high yield (>85%) by refining lignocellulose-containing material such as chips, sawdust or defibred chips. The material is preheated and/or treated with lignin-softening chemicals prior to the refining, which usually is carried out in disc refiners.

At conventional embodiments of the refining process the fibre material is refined at very high fibre concentrations, in such a manner, that the amount of water supplied to the refiner is held at the lowest possible level. This is necessary for obtaining good properties of the exposed fibres and for rendering them suitable for the manufacture of a series of different paper qualities. The refining process, however, requires much energy. Therefore, in view of the ever increasing energy prices and the restricted energy supply it is increasingly disadvantageous to make mechanical or chemi-mechanical pulps of the above yields by this process.

It was, however, found very surprisingly that it is possible by the present invention to substantially reduce the energy consumption at the refining without abandoning the quality of the resulting pulp. In certain cases even an improvement of the quality was observed.

The fibre material is decomposed at the refining to fibres or fibre fragments while the material is passing through the narrow gap between the refining segments in the disc refiner. As regards the process parameters, such as pressure, temperature, concentration, production, refining disc pattern etc. in the refiner, it is essential to choose them so as to obtain a gap of adequate size at the desired effect input and processing of the fibre material. Too narrow a gap implies difficulties for the pulp transport through the gap and often results in a poor pulp quality because many fibres during their passage between the discs are cut off or damaged in cessing of the fibre material is not obtained during a single passage, but the refining operation must be repeated two or more times with the entire pulp amount or with a part thereof, i.e. the refining must be carried out in several steps. The steam, besides, occupies a vary large part of the space in the gap between the operating refining discs. For this reason, and because the fibre material at high concentraions is not distributed uniformly in the gap and over the refining segments, the possibilities offered by the refining segments cannot all be utilized for processing the fibre material.

Although the greater part of the steam formed flows out at the periphery of the refining segments, a non-neglectible part thereof flows back and out of the refiner where the chips are being fed in. This feed, of course, is obstructed thereby, which gives rise to serious effect variations. Such a varying fibre flow through the refiner, of course, has a detrimental effect on the pulp quality. When the fibre flow is too great, the fibres are refined insufficiently, and when the flow is too small, the fibres will be refined much too intensely.

The steam flow, partially in forward and partially in rearward direction, is due to the fact that the pressure in the gap between the refining segments increases with increased energy transfer in the direction to the periphery and reaches a maximum somewhere in the outer part. The energy transfer and the steam formation are here at their maximum, and this area constitutes a natural divider for the forward/rearward steamflow.

Thus, great steam amounts difficult to manage are formed when the refining of fibre material must be carried out at high fibre concentrations. The fibre concentrations, determined immediately after the refining, mostly are in the range of 25–35%. The steam problems, therefore, determine to a high degree the design of the disc segments, i.e. of the instruments applied to refining the fibre material. Grooves and ridges, thus must be formed so that the grooves are sufficiently wide and deep for not obstructing the steam transport. Often, on the other hand, a narrower groove and a wider ridge would be more advantageous with respect to the refining of the fibres, but are not permissible in view of the steam transport. It further is desirable to maintain the fibre material for as long as possible upwardly about ridge surfaces and edges, so that the material will be accessible to the refining effected by the edges and surfaces of the ridges. Grooves with great depth would render this difficult. Furthermore, according to new refining theories an effective refining of the fibre material requires a continuous and rapid redistribution of the material, which also is rendered difficult by too deep grooves and high fibre concentration.

It is apparent from the aforesaid, that it is highly desirable to carry out the refining of fibre materal at fibre concentrations, which are lower than permissible according to the technology of today. By lowering the concentration, the steam formation is reduced and the fibre flow through the refiner is facilitated. The fibre material is distributed more uniformly across the refining surfaces, the material in the grooves is more easily and rapidly redistributed, and the possibilities of refining fibres and chips are better utilized. The substantially reduced steam formation permits a more rational design of the refining segments.

These advantages of a low pulp concentration express themselves in such a way, that at a lowering of the pulp concentration below 15% a distinct reduction of the energy consumption for a certain refining degree of the fibre material, calculated as freeness, can be observed. It is difficult, however, to utilize this effect with the technology of to-day, because simultaneously the gap decreases so much at the refining of these low concentrations, that the strength properties of the pulp deteriorate due to fibre damages, as mentioned above.

The present invention provides a sufficient retention time for the fibre material in the refiner, so that the specific effect input can be held at a level where fibre damages are prevented although the refining is carried out in the concentration range 8–15% calculated as discharge concentration. This implies, that the energy consumption at the refining can be reduced substantially and at the same time the quality of the pulp produced is maintained or even improved.

This is possible due to the fact that the pulp flow through the refiner according to the invention is reduced effectively.

The characterizing features of the invention become apparent from the attached claims.

The invention is described in greater detail in the following, with reference to the attached FIGURE, which schematically shows a refiner for carrying out the method according to the invention. The refiner shown is a disc-refiner, of which both refining discs rotate in relation to one another, but the invention is applicable also to a refiner comprising one stationary and one rotating refining disc.

The refiner comprises a stand 1, in whcih two shafts 2, 3 are supported. The shafts are driven in opposed directions by motors 4, 5 and are provided at one end with refining segment holders 6, 7, on which refining segments 8, 9 are attached. Between the refining segments 8, 9 a gap 10 is formed which can be adjusted by displacing one shaft 2 and associated segment holder 6 in axial direction. The second segment holder 7 is provided with openings 11 for material supply which communicate with a charging device 12. A supply conduit 13 for diluting water is connected to the material inlet. The amount of diluting water supplied is controlled by a valve 14.

The segment holders 6, 7 are enclosed by a closed refiner housing 15, to which, preferably to its lower portion, a supply conduit 16 for diluting water is connected. The supply can be controlled by a valve 17. For the discharge of the refined material an outlet conduit 18 is connected to the refiner housing, preferably to its upper portion. The pressure in the refiner housing is controlled by a valve 19.

The lignocellulose-containing material to be refined is preheated with steam and/or treated with lignin-softening chemicals, for example $Na_2SO_3$, prior to the refining in a known manner. The material is advanced by a feed screw 12 and flows in through the openings 11 in the segment holder 7 and flows out through the gap 10. The pressure in the feed zone, i.e. where the material is charged through the openings 11, usually is maintained between 10 and 260 kPa, preferably between 20 and 140 kPa. This corresponds to a temperature of approx. 100°-140° C., preferably 105°-125° C.

The material concentration is held at the refining within 8-15%, calculated as discharge concentration, i.e. the concentration of the material when leaving the gap. This concentration is adjusted by the supply of diluting water of a suitable temperature through the conduit 13.

By continuous and controlled supply of diluting water, preferably backwater of the mill, through the conduit 16, the pulp is diluted after the refining to a concentration easy to pump, suitably 1-6%, and preferably 2-5%, so that the refiner housing 15 is held filled with the fibre suspension. Hereby the fibre suspension in the refiner housing forms a wall about the outlet opening of the gap and brakes the acceleration of the fibre material through the gap. The material remains longer in the gap, and the low concentration permits a more uniform distribution of the material. The flow through the gap assumes the character of plug flow.

The staying time of the material in the gap also is affected by the pattern of the refining segments. In the present case a dense pattern is desired, i.e. the grooves shall have small depth and width dimensions. The refining segments, for example, may be designed with a refining zone where the groove width is smaller than 2 mm and the groove depth below 4 mm. The grooves of the refining segments also are to be provided with a great number of ridges. Such a pattern, as mentioned before, also contributes to a more effective refining of the fibres.

In the refiner housing 15, outside the refining discs a pressure is maintained which substantially corresponds to the pressure in the feed zone. It may, however, be suitable under certain circumstances to maintain in the refiner housing a higher pressure than in the feed zone. Hereby the retention time of the material in the gap can be extended still more. The pressure in the refiner housing is controlled by the valve 19 in the discharge conduit 18 from the refiner housing. The low concentration in the refiner housing provides a uniform flow through said housing. The low concentration also implies that the pressure drop over the valve 19 is easier to control, whereby also the pressure in the refiner housing and the entire refining operation are easier to control.

Due to the fact that the concentation at the refining is held at a low level (8-15%), the amount of steam formed is much smaller than it normally would be. No steam, or very little steam, flows backward against the incoming chips, and the steam flowing out through the gap has low speed and condenses substantially immediately in the fibre suspension surrounding the segment holders. Owing to the fact that the refiner housing is filled with a fibre suspension of low concentration, also heat is conducted away more effectively from the refining zone, which further contributes to a limitation of the steam formation in the refining zone.

It is also possible to utilize defibred chips as starting material. The feed screw 12 then can be replaced by a pulp pump, the discharge conduit of which is connected directly to the feed zone of the refiner. Defibred chips in this case are to be understood as a fibre material which in a preceding operation partially has been defibred with very little energy. The defibring operation may take place subsequent to a preheating and/or treatment with lignin-softening chemicals. The gap at this operation is great, and the fibre damages are insignificant. The refining, i.e. the main application of energy, thereafter takes place in the way described above.

The refining of fibre material at low concentration, preferably in the range 2-5%, per se has been applied since long. The material, however, was fibre material of low yield, most usually about 50%, so-called chemical pulps, or of yields up to 80%, so-called semi-chemical pulps. In both cases the fibres have a character quite different from that in the yield range, to which the present invention refers (>85%). Said low yields, below 80%, render flexible fibres, which can be refined at low concentration and in small gaps without destroying the fibres. Moreover, never or very seldom the energy requirements are higher than 400-500 kWh/ton, which is about half or one third of the energy amount required for a satisfactory refining of high-yield fibre according to the invention. It is, further, to be observed that the fibre concentration in these cases (2-5%) is the same both in the gap and in the refiner housing. A fibre material, which after refining can be characterized as mechanical or chemi-mechanical pulp, is refined according to conventional technology from raw material to pulp at high concentration, 20-40%.

The invention, of course, is not restricted to the embodiments described, but can be varied within the scope of the invention lidea.

We claim:

1. A method for refining lignocellulose containing material comprising the steps of pretreating the lignocellulose containing material with a medium selected from steam, heat, lignin-softening chemicals and combinations thereof; refining the pre-treated lignocellulose containing material in a refining zone of a disc refiner containing refiner discs and a housing surrounding said refiner zone, wherein during said refining step water is added to said lignocellulose containing material and the lignocellulose containing material is passed through a gap between the refining discs so as to form a suspension containing said lignocellulose containing material in a concentraion of from 8% to 15% at the point of discharge of said suspension from said gap and so as to substantially reduce the steam development in said gap, thereby reducing the steam flow backwards against the lignocellulose containing material coming into said refining zone; and passing said suspension into said housing surrounding the refiner discs, wherein water is supplied to said refiner housing to form a diluted suspension such that the concentration of the refined lignocellulose containing material in said diluted suspension exiting the refiner from the housing is in the range of from 1% to 6% and wherein said refiner housing is maintained filled with said diluted suspension to increase the retention time of the material in said gap by breaking the acceleration of the material coming through said gap, to condense steam flowing through said gap, and to conduct heat away from said refining zone.

2. A method according to claim 1, wherein an overpressure is maintained at the entrance of said material into the gap between said refining discs.

3. A method according to claim 2, wherein the same overpressure is maintained in refiner housing surrounding the refining discs.

4. A method according to claim 2 or 3, wherein said overpressure is maintained between 20 and 140 kPa.

5. A method according to claim 1 or 2, wherein a material concentration in the gap between the refining discs is maintained by adding water to the material as the material enters the gap between the refining discs and by controlling the amount of water so supplied.

6. A method according to claim 1 or 2, wherein the water for diluting the material in the refiner housing is supplied to a lower portion of the refiner housing and said diluted suspension is discharged from the upper portion of said refiner housing.

* * * * *